US009694943B2

(12) United States Patent
Shioda

(10) Patent No.: US 9,694,943 B2
(45) Date of Patent: Jul. 4, 2017

(54) ZIPPER TAPE WITH CUT TAPE, AND PACKAGING BAG PROVIDED WITH ZIPPER TAPE WITH CUT TAPE

(71) Applicant: JAPAN TAKEBISHI Co., Ltd., Tokyo (JP)

(72) Inventor: Kazuaki Shioda, Saitama (JP)

(73) Assignee: JAPAN TAKEBISHI CO., LTD., Tokyo (JP)

( * ) Notice: Subject to any disclaimer, the term of this patent is extended or adjusted under 35 U.S.C. 154(b) by 0 days.

(21) Appl. No.: 14/582,327

(22) Filed: Dec. 24, 2014

(65) Prior Publication Data

US 2015/0183556 A1 Jul. 2, 2015

(30) Foreign Application Priority Data

Dec. 26, 2013 (JP) ..... 2013-269146

(51) Int. Cl.
*B65D 33/00* (2006.01)
*B65D 33/25* (2006.01)

(52) U.S. Cl.
CPC ..... *B65D 33/2508* (2013.01); *Y10T 24/158* (2015.01)

(58) Field of Classification Search
CPC ..... B65D 33/2533; B65D 33/2508; B65D 33/2541; B65D 33/2575; B65D 33/2583; Y10T 24/158
USPC ..... 383/63, 204
See application file for complete search history.

(56) References Cited

U.S. PATENT DOCUMENTS 5,157,811 A * 10/1992 Bodolay ..... B65B 9/093 24/30.5 R
5,660,479 A * 8/1997 May ..... B65D 33/2525 383/202
7,476,030 B1 * 1/2009 Kuge ..... B65D 33/2533 383/203
8,066,434 B2 * 11/2011 Nanba ..... B65D 33/2575 383/204
8,540,428 B2 * 9/2013 Nanba ..... B29C 65/02 383/200
8,646,972 B2 2/2014 Tanaka et al.
9,011,006 B2 * 4/2015 Goto ..... B65D 33/2508 383/200
2003/0202720 A1 * 10/2003 VandenHeuvel .... B65D 33/007 383/204
2007/0183692 A1 8/2007 Pawloski
(Continued)

FOREIGN PATENT DOCUMENTS

AU 2014280896 A1 7/2015
JP 2002104440 A 4/2002
JP 2004155446 A 6/2004
(Continued)

OTHER PUBLICATIONS

Australian Patent Office, Patent Examination Report issued on Nov. 10, 2015.

*Primary Examiner* — Peter Helvey
(74) *Attorney, Agent, or Firm* — Li & Cai Intellectual Property (USA) Office

(57) ABSTRACT

A zipper tape with a cut tape that makes it possible to reduce the number and area of parts bonded to a bag body, reduce the defectives rate, and unseal a bag in a reliable manner at a predetermined position; and a packaging bag provided with the zipper tape with a cut tape.

16 Claims, 5 Drawing Sheets

(56) References Cited

U.S. PATENT DOCUMENTS

| | | | | |
|---|---|---|---|---|
| 2008/0310774 | A1* | 12/2008 | Turvey | B65D 33/2508 383/63 |
| 2009/0238500 | A1* | 9/2009 | Nanba | B65D 33/2533 383/203 |

FOREIGN PATENT DOCUMENTS

| | | | |
|---|---|---|---|
| JP | 2013227068 | A | 11/2013 |
| TW | I392623 | | 4/2013 |
| WO | WO 2006/062136 | A1 | 6/2006 |
| WO | WO2010/024241 | A1 | 3/2010 |

* cited by examiner

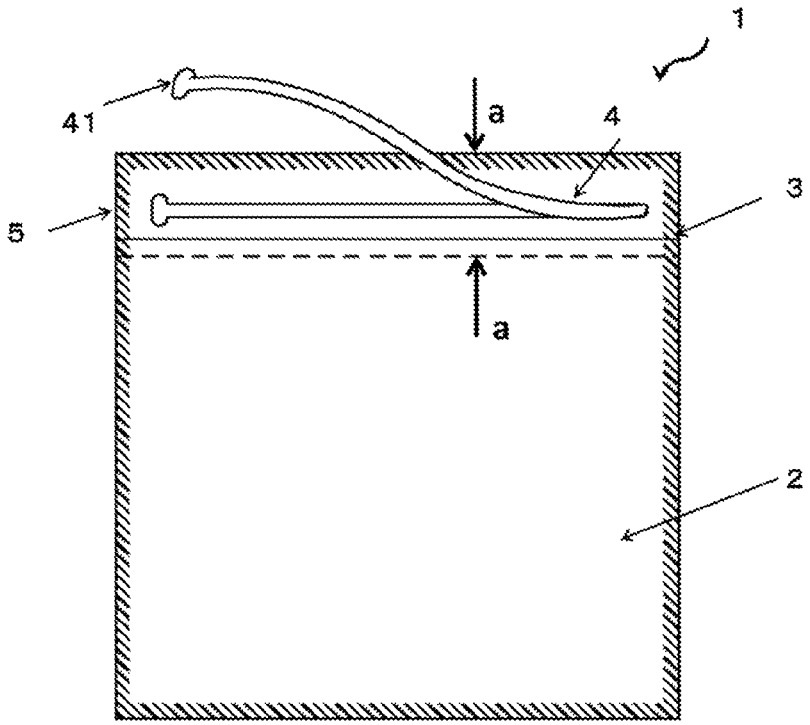
【FIG. 1】
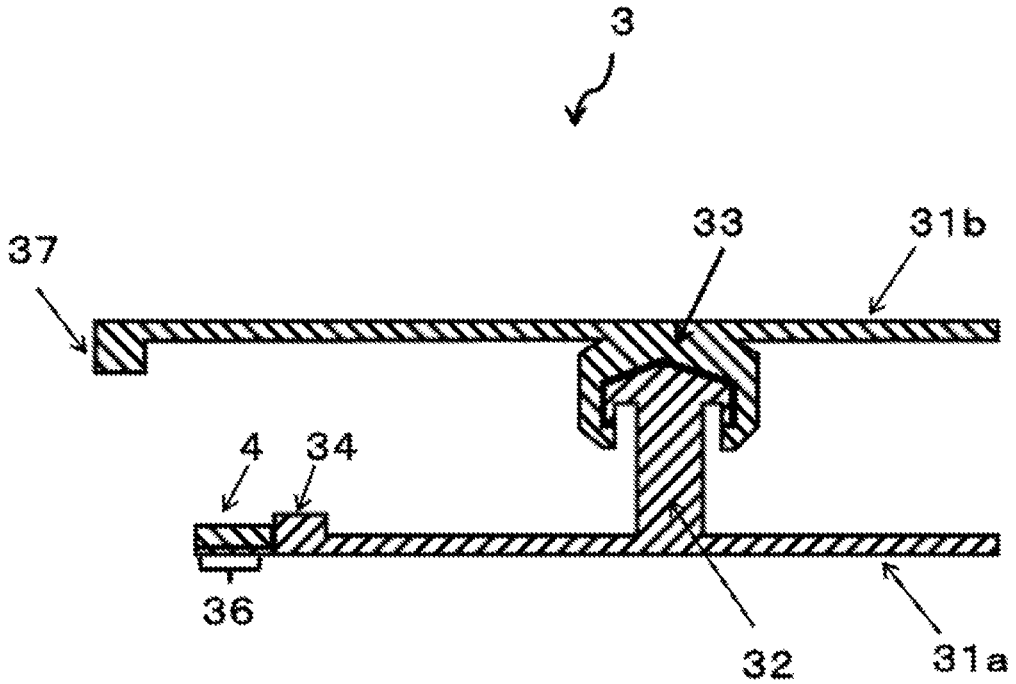
【FIG. 2】

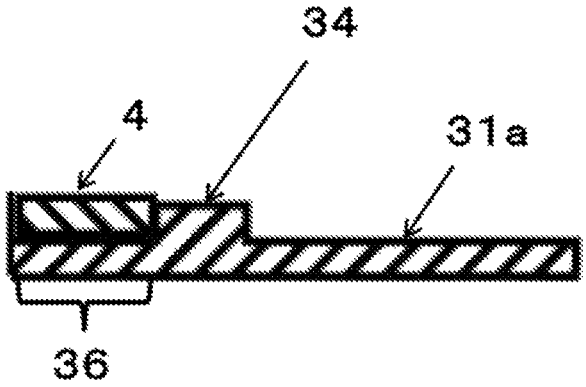
【FIG. 3】
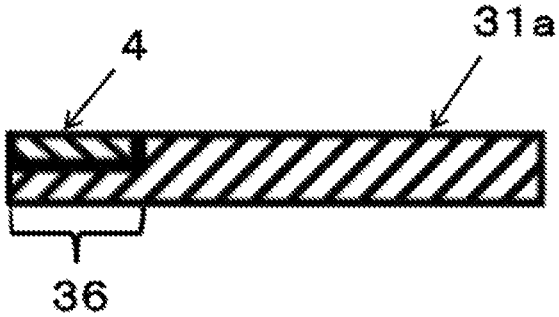
【FIG. 4】
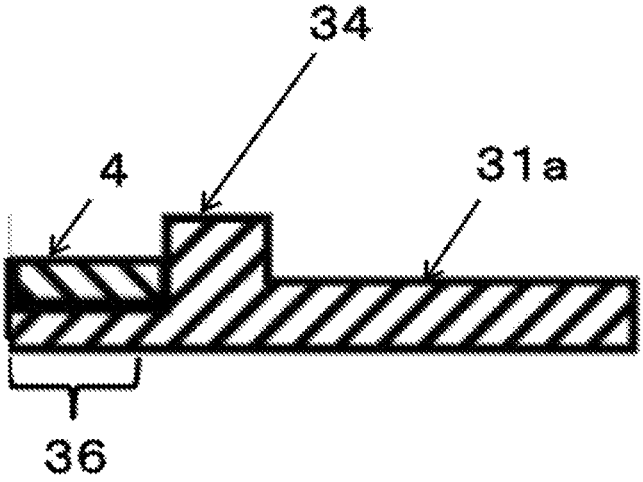
【FIG. 5】

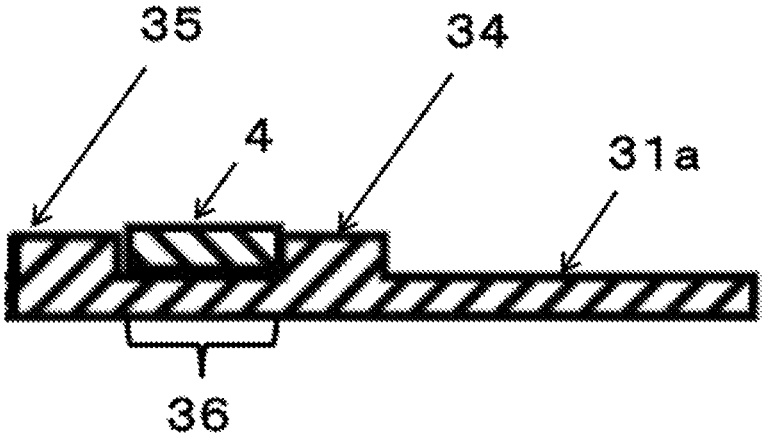
【FIG. 6】
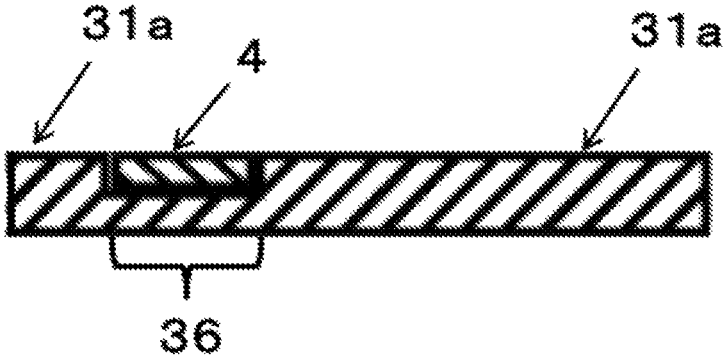
【FIG. 7】
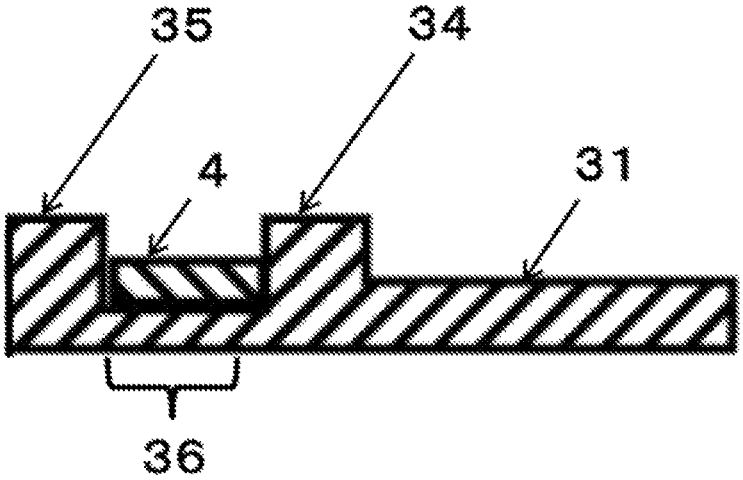
【FIG. 8】

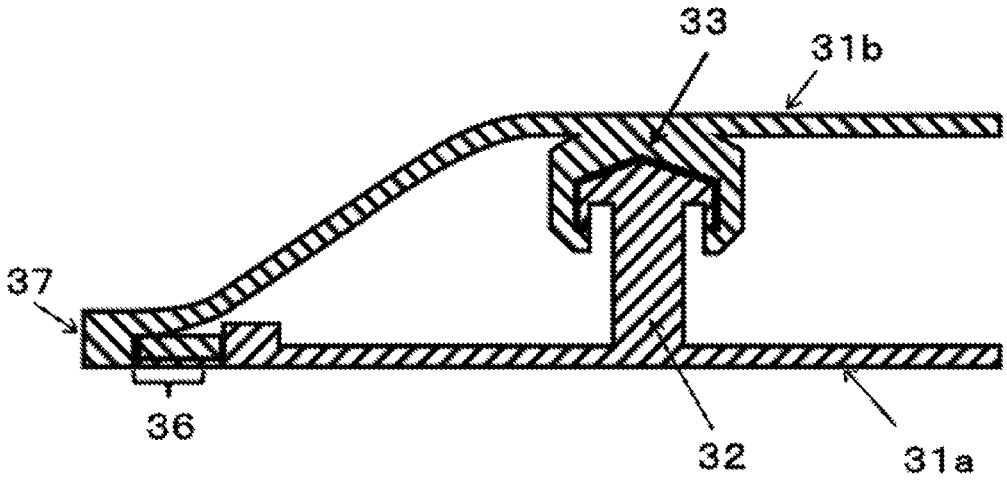
【FIG. 9】
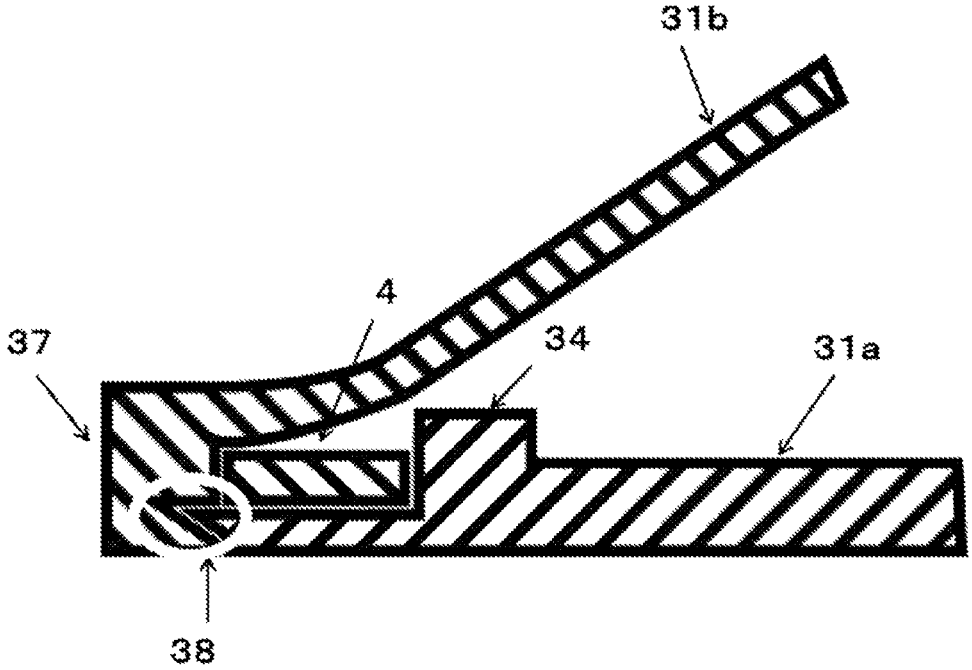
【FIG. 10】

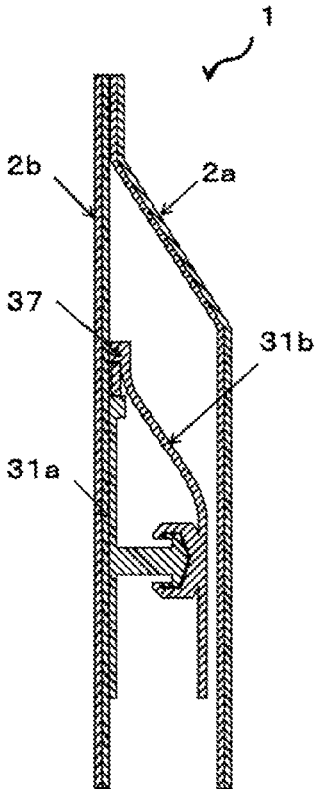
【FIG. 11】
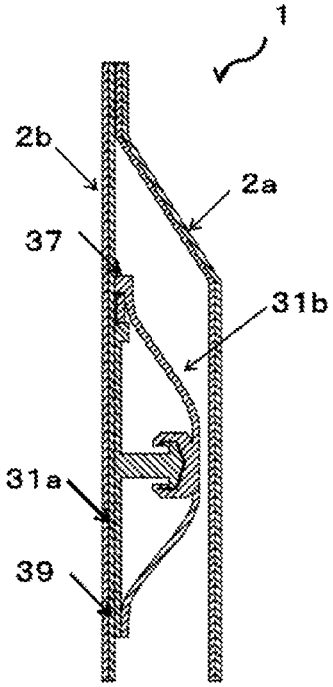
【FIG. 12】

ZIPPER TAPE WITH CUT TAPE, AND PACKAGING BAG PROVIDED WITH ZIPPER TAPE WITH CUT TAPE

TECHNICAL FIELD

The present invention relates to a zipper tape with a cut tape and a packaging bag provided with a zipper tape with a cut tape, and in particular, relates to: a zipper tape with a cut tape in which the number of bonded components and the area of bonding between the zipper tape and the packaging bag are reduced, thereby making it possible to minimize the number of defectives, and in which the packaging bag can be accurately opened; and a packaging bag provided with a zipper tape with a cut tape.

TECHNICAL BACKGROUND

Packaging bags provided with a zipper tape with a cut tape are easy to open and close and have an excellent sealing performance, and are therefore widely employed as packaging bags for storing food items as well as for packaging a variety of other articles such as chemicals, clothing items, industrial components, and general goods.

A packaging bag provided with a zipper tape with a cut tape of such description is sealed by sealing the upper part of the zipper tape, and can be unsealed by tearing a bag body film of the packaging bag using the cut tape.

A known example of a packaging bag provided with a zipper tape with a cut tape of such description includes a packaging bag in which a strip-shaped sheet having a ridge, a strip-shaped sheet having a groove which engages with the ridge, and a cut tape are bonded to a bag body (see Patent Document 1). However, in the invention disclosed in Patent Document 1, because each of the two strip-shaped sheets and the cut tape are bonded to the bag body, a problem is presented in that when the seal is opened, when stretching or a similar deformation occurs when the bag body is torn by the cut tape, the ridge and the groove become misaligned, making it difficult to open and close the zipper tape. In addition, since there is a need to bond the members to the bag body at three locations, a problem is presented in an increased rate of defectives due to defective bonding.

Also known is a bag to which is bonded a zipper tape with a cut tape formed of a first base material integrally provided with a cut tape and a second base material provided with a member which engages with the member formed on the first base material (see Patent Document 2). In the invention disclosed in Patent Document 2, only the first base material is bonded to the bag body; therefore, it is possible to reduce the defectives rate due to defective bonding. However, in the zipper tape disclosed in Patent Document 2, the zipper tape is integrally provided to the first base material; therefore, a problem is presented in regard to increased difficulty when adjusting the force necessary to separate the cut tape. In addition, in the zipper tape disclosed in Patent Document 2, it is necessary to bond an end part of the second base material at a position displaced from the portion of the first base material at which the cut tape is formed. However, a problem is presented that in order to bond or fuse the end part of the second base material so as to not overlap with the cut tape portion of the first base material and to prevent the engaging parts provided to the first base material and the second base material from becoming misaligned, the bonding step becomes cumbersome.

PRIOR ARTS LIST

Patent Documents

Patent Document 1: Japanese Laid-open Patent Publication No. 2004-155446

Patent Document 2: Japanese Laid-open Patent Publication No. 2013-227068

SUMMARY OF THE INVENTION

Problems to be Solved by the Invention

The present invention was contrived in order to solve the above problem of the prior art, and was perfected upon it being discovered, as a result of thoroughgoing studies, that: bonding, to a bag body, a zipper tape with a cut tape that includes a first strip-shaped base part provided with a male member and a second strip-shaped base part provided with a female member for engaging with the male member, one of the strip-shaped base parts including a lamination part for laminating a cut tape and a cut tape laminated on the lamination part, the lamination part being formed so as to be thinner than an adjacent portion, and a convex part to be bonded to a bag body being formed at an end part of the other strip-shaped base part, makes it possible to (1) adjust the force used to separate the cut tape and the lamination part, (2) reduce the number of parts bonded to the bag body, and (3) bring the convex part into contact with, or lock the convex part with, the end part of the strip-shaped base part on which the lamination part is formed, and bond the convex part to the bag body; and as a result, it becomes possible to unseal the bag body along a predetermined shape using minimal force, and to reduce the rate of defectives produced during the manufacturing process.

In other words, an object of the present invention is to provide a zipper tape with a cut tape and a packaging bag provided with a zipper tape with a cut tape.

Means to Solve the Problems

The present invention relates to the following zipper tape with a cut tape and packaging bag provided with a zipper tape with a cut tape.

(1) A zipper tape with a cut tape, the zipper tape with a cut tape including a first strip-shaped base part provided with a male member and a second strip-shaped base part provided with a female member for engaging with the male member;

one strip-shaped base part among the first strip-shaped base part and the second strip-shaped base part including a lamination part for laminating a cut tape and a cut tape laminated on the lamination part, the lamination part being formed so as to be thinner than an adjacent portion; and a convex part to be bonded to a bag body being formed at an end part of the other strip-shaped base part, and the height of the convex part being equal to or greater than the thickness of a lamination-part-side end part of the strip-shaped base part on which the lamination part is formed.

(2) The zipper tape with a cut tape according to (1) above, wherein the lamination part is formed as a thin part which is thinner than the strip-shaped base part excluding the lamination part.

(3) The zipper tape with a cut tape according to (1) above, wherein the strip-shaped base part adjacent to the lamination part is formed as a first thick part and a second thick part which are thicker than the lamination part.

(4) The zipper tape with a cut tape according to (1) above, wherein the lamination part is formed as a thin part which is thinner than the strip-shaped base part, and portions adjacent to the lamination part are formed as a first thick part and a second thick part which are thicker than the strip-shaped base part.

(5) The zipper tape with a cut tape according to (1) above, wherein the lamination part is formed as a thin part formed at an end part of the strip-shaped base part so as to be thinner than the strip-shaped base part adjacent to one end of the lamination part.

(6) The zipper tape with a cut tape according to (1) above, wherein the lamination part is formed at an end part of the strip-shaped base part, and a portion adjacent to one end of the lamination part is formed as a first thick part thicker than the strip-shaped base part.

(7) The zipper tape with a cut tape according to (1) above, wherein the lamination part is formed at an end part of the strip-shaped base part, a portion adjacent to one end of the lamination part is formed as a first thick part thicker than the strip-shaped base part, and the lamination part is formed as a thin part thinner than the strip-shaped base part.

(8) The zipper tape with a cut tape according to any of (1) to (7), wherein the convex part, the male member, and the female member are formed at a position at which the male member and the female member engage when an end part, on the side at which the lamination part is provided, of the strip-shaped base part that includes the lamination part has the convex part of the other strip-shaped base part brought into contact therewith.

(9) The zipper tape with a cut tape disclosed in any of (1) to (8), provided with a locking member capable of locking an end part of the strip-shaped base part that includes the lamination part and the convex part of the other strip-shaped base part to each other.

(10) The zipper tape with a cut tape according to (9) above, wherein the locking member is provided at a position at which a face along which the convex part and the strip-shaped base part that includes the lamination part are bonded to the bag body forms a flat surface when the end part of the strip-shaped base part that includes the lamination part and the convex part of the other strip-shaped base part are locked to each other.

(11) The zipper tape with a cut tape according to any of (1) to (10), wherein an incision line is provided at a boundary between the lamination part and the adjacent portion.

(12) The zipper tape with a cut tape according to any of (1) to (11), wherein at least two or more pairs of the male member and the female member are provided.

(13) A packaging bag provided with a zipper tape with a cut tape, to which is bonded the zipper tape with a cut tape according to any of (1) to (12).

(14) The packaging bag provided with a zipper tape with a cut tape according to (13) above, wherein the lamination part and the portion adjacent to the lamination part, and the convex part, of the zipper tape with a cut tape are bonded to at least the packaging bag.

(15) The packaging bag provided with a zipper tape with a cut tape according to (13) or (14) above, wherein an end part of a strip-shaped base part on the opposite side from the lamination part of the strip-shaped base part provided with the lamination part, and an end part of a strip-shaped base part on the opposite side from the convex part of the strip-shaped base part provided with the convex part, are bonded to each other.

Advantageous Effects of the Invention

In a zipper tape with a cut tape according to the present invention, the cut tape is laminated on a lamination part formed so as to be thinner than an adjacent portion. Therefore, when the cut tape of the packaging bag provided with a zipper tape provided with a cut tape of the present invention is pulled, the lamination part is cut off along the boundary with a strip-shaped base part. In addition, since the lamination part, the portion adjacent to the lamination part, and a convex part are bonded to the bag body, when the lamination part is separated from the strip-shaped base part, the portion of the bag body bonded to the lamination part is separated from the bag body together with the lamination part, but other portions of the bag body are bonded to the portion adjacent to the lamination part and are not readily separated with the lamination part. Accordingly, the bag can be unsealed in a reliable manner at a predetermined position. Also, in a case in which the lamination part is provided to an end part of a strip-shaped base part and a convex part of another strip-shaped base part is bonded to the bag body so as to be adjacent to the lamination part, the bag body 2 and the convex part are bonded, therefore making it possible to unseal the bag in a reliable manner at a predetermined position.

In the zipper tape with a cut tape according to the present invention, the cut tape is laminated on a lamination part which is formed so as to be thinner than an adjacent portion. As a result, it becomes possible to adjust the force with which the cut tape is fully pulled.

In the zipper tape with a cut tape according to the present invention, bonding to the bag body is performed only at two locations, therefore making it possible to reduce the defectives rate. In addition, providing the convex part, the male member, and the female member at a position at which the male member and the female member engage when an end part, on the side at which the lamination part is provided, of the strip-shaped base part that includes the lamination part has the convex part of the other strip-shaped base part brought into contact therewith, makes it possible to bond the convex part and the strip-shaped base part provided with the lamination part to the bag body without any positional misalignment, making it possible to reduce the defectives rate. In addition, providing a locking member capable of locking the end part of the strip-shaped base part that includes the lamination part and the convex part of the other strip-shaped base part to each other makes it possible to further reduce the defectives rate.

BRIEF DESCRIPTION OF THE DRAWINGS

FIG. 1 is a front view of a packaging bag provided with a zipper tape with a cut tape according to the present invention;

FIG. 2 is a cross-section view of an example of the zipper tape 3 with a cut tape of the present invention;

FIG. 3 is an enlarged cross-section view of the zipper tape 3 shown in FIG. 2 in the vicinity of the cut tape 4;

FIG. 4 is a cross-section view of another embodiment of the zipper tape 3 in the vicinity of the cut tape 4;

FIG. 5 is a cross-section view of another embodiment of the zipper tape 3 in the vicinity of the cut tape 4;

FIG. 6 is a cross-section view of another embodiment of the zipper tape 3 in the vicinity of the cut tape 4;

FIG. 7 is a cross-section view of another embodiment of the zipper tape 3 in the vicinity of the cut tape 4;

FIG. 8 is a cross-section view of another embodiment of the zipper tape 3 in the vicinity of the cut tape 4;

FIG. 9 shows a positional relationship present when the zipper tape 3 of the present invention is used.

FIG. 10 is a cross-section view of another embodiment of the zipper tape 3 in the vicinity of the cut tape 4;

FIG. 11 is a cross-section view along line a-a of the packaging bag 1 shown in FIG. 1; and FIG. 12 is a cross-section view along line a-a according to another embodiment of the packaging bag 1 of the present invention.

DESCRIPTION OF THE EMBODIMENTS

A detailed description will now be given for a zipper tape with a cut tape and a packaging bag provided with a zipper tape with a cut tape according to the present invention.

FIG. 1 is a front view of a packaging bag 1 provided with a zipper tape with a cut tape (may hereafter be referred to as "packaging bag") according to the present invention. The packaging bag 1 includes a bag body 2, a zipper tape 3, and a cut tape 4 which is layered on a lamination part of the zipper tape 3 and which is capable of also separating the lamination part. A seal 5 is present around the outer periphery of the bag body 2, whereby a sealed state is produced.

No particular restriction applies to the bag body 2 as long as the bag body 2 is made of a material commonly used in this field. Examples of suitable materials include: an arbitrary synthetic resin material such as a polypropylene film, a nylon film, a low-density polyethylene (LDPE) film, a high-density polyethylene (HDPE) film, a polyethylene terephthalate (PET) film, or a film onto which aluminium or another metal has been vapour-deposited; a fibrous material such as paper; biodegradable plastic; or another material capable of forming a bag body. The bag body 2 may be single-layered or laminated. The shape of the bag body 2 is not limited to a three-way seal type shown in FIG. 1 in which upper and lower films are placed together and the surroundings (three locations) of the bag are sealed. No particular limitations exist as long as the configuration is that of a bag body, such as: a half-folded type, in which a single film is folded in half and a joining part is sealed; a centre seal type, in which a single film is folded inwards from the left and right and sealed; a melt-cut type produced by cutting while sealing a film; or a rectangular-bottomed bag type having a flat bottom.

In a case in which a laminated configuration is used for the bag body 2, a laminated film primarily made of a plastic may be used. In a case in which a laminated film is used, a laminated film in which a sealant layer is laminated as the innermost layer is commonly used; however, a variety of configurations of the laminated film can be used according to factors such as the contents to be packed or usage conditions. For example, the laminated film may be configured by laminating, as an intermediate layer, a water vapour barrier layer or another gas barrier layer, a light-shielding layer, a reinforcing layer, or another layer between a base material film layer and a sealant layer according to the required properties. Each of the base material film layer, the intermediate layer, and the sealant layer may be formed from a single layer or by laminating a plurality of layers.

For the base material film layer, a biaxially stretched polypropylene film, as well as: a biaxially stretched polyester film such as a biaxially stretched polyethylene terephthalate film or a biaxially stretched polyethylene naphthalate film; or a biaxially stretched polyamide film obtained by biaxially stretching a nylon-6, a nylon-66, an MXD6 (polymetaxylylene adipamide), or another film, are suitable for use. The above films may be used singly or in a laminated combination of a plurality thereof.

In a case in which a gas barrier layer is used as the intermediate layer: a film made of saponified ethylene-vinyl acetate copolymer (EVOH), polyvinylidene chloride (PVDC), polyacrylonitrile (PAN), MXD6, or a similar material; a foil made of aluminium or another metal; or a biaxially stretched polyethylene terephthalate film (PET film), a biaxially stretched polypropylene film (OPP film), or a biaxially stretched nylon film (ON film) provided with a coating layer made of polyvinylidene chloride (PVDC), polyvinyl alcohol (PVA), polyacrylic acid (PAA), or a similar material, or a vapour deposition layer made of silica, alumina, zinc oxide, magnesium oxide, ITO, aluminium, or another inorganic oxide or metal, may be used as the intermediate layer. From among the above, a film provided with an aluminium vapour deposition layer or an aluminium foil is opaque and light-shielding, and can therefore also function as a light-shielding layer. In a case in which a reinforcing layer is used as the intermediate layer, any of the above base material films may be additionally laminated as appropriate, or a biaxially stretched high-density polyethylene film or the like may be laminated so as to also function as a moisture-proofing layer. The base material film layer and the intermediate layer may be laminated by a known dry lamination method or extrusion lamination (sandwich lamination) method.

For the sealant layer on the innermost layer, in addition to low-density polyethylene (LDPE) or linear low-density polyethylene (L•LDPE), an ethylene-α-olefin copolymer, an ethylene-vinyl acetate copolymer (EVA), an ethylene-acrylic acid copolymer (EAA), an ethylene-methacrylic acid random copolymer (EMAA), an ethylene-methyl acrylate copolymer (EMA), an ethylene-ethyl acrylate copolymer (EEA), or another ethylene-acrylate copolymer polymerized using a single-site catalyst; an ionomer, polypropylene or a copolymer thereof; or another polyolefin resin may be used. A suitable resin from above may be selected as appropriate and used according to the contents to be packed. Possible methods for laminating the sealant layer include a method in which an above resin is formed into a film shape and the film is laminated by dry lamination or extrusion lamination, or a method in which the above resin is applied as a coating by extrusion and laminated. In a case in which the contents include a substance that readily permeates the sealant layer, the sealant layer is preferably laminated by dry lamination which results in a superior bonding strength.

FIG. 2 is a cross-section view of an example of the zipper tape 3 with a cut tape 4 of the present invention. The zipper tape 3 shown in FIG. 2 comprises a first strip-shaped base part 31*a* and a second strip-shaped base part 31*b*. The first strip-shaped base part 31*a* includes a male member 32, a lamination part 36 formed at an end part of the first strip-shaped base part 31*a*, the cut tape 4 laminated on the lamination part 36, and a first thick part 34 in which a portion of the strip-shaped base part 31 adjacent to the cut tape 4 has a larger thickness. The second strip-shaped base part 31*b* includes a female member 33, which forms an engaging part with the male member 32, and a convex part 37 which is bonded to the bag body 2. The male member 32, the female member 33, the first thick part 34, the lamination part 36, the convex part 37, and the cut tape 4 are provided so as to be continuous in the longitudinal direction (lateral direction in FIG. 1).

No particular limitations exist for the shapes of the male member 32 and the female member 33 as long as the male member 32 and the female member 33 can be engaged or disengaged with respect to each other. Engaging or disengaging the male member 32 and the female member 33 with respect to each other makes it possible to unseal or reseal the packaging bag 1 provided with the zipper tape 3.

FIG. 3 is an enlarged cross-section view of the zipper tape 3 in the vicinity of the cut tape 4. In the zipper tape shown in FIG. 3, the lamination part 36 on which the cut tape 4 is laminated is formed at an end part to the same thickness as that of the first strip-shaped base part 31*a*, and the section of the strip-shaped base part 31*a* adjacent to the lamination part 36 is formed as the first thick part 34 that is thicker than the lamination part 36. Since the lamination part 36 on which the cut tape 4 is laminated is thinner than the adjacent first thick part 34, pulling the cut tape 4 makes it possible to separate the cut tape 4 and the lamination part together from the zipper tape 3 at the boundary portion between the lamination part 36 and the first thick part 34. There are no particular restrictions on the thickness of the first strip-shaped base part 31*a* as long as the lamination part 36 can be cut off, but normally, a thickness of 150 to 170 μm is suitable. It is undesirable for the strip-shaped base part 31*a* to be too thin as the overall strength would be insufficient, and it is undesirable for the strip-shaped base part 31*a* to be too thick as it would be difficult to cut off the lamination part 36; in addition, if the zipper tape 3 is wrapped around a drum roll or a similar item, the shape will be maintained in a bent state, and the bent shape will remain even after the zipper tape 3 is bonded to the packaging bag 1. There are no particular restrictions on the thickness of the first thick part 34 as long as the lamination part 36 can be separated at the boundary portion, but the first thick part 34 is preferably about two to three times the thickness of the first strip-shaped base part 31*a*. The width of the cut tape 4 and the lamination part 36 and the thickness of the first thick part 34 may be adjusted as appropriate according to the size of the packaging bag 1 to which the elements are provided.

FIG. 4 is a cross-section view of another embodiment of the zipper tape 3 in the vicinity of the cut tape 4. In the zipper tape 3 shown in FIG. 4, the lamination part 36 on which the cut tape 4 is laminated is formed as a thin part which is thinner than the first strip-shaped base part 31*a*. As with the embodiment shown in FIG. 3, the lamination part 36 (thin part) on which the cut tape 4 is laminated is thinner than the adjacent first strip-shaped base part 31*a*. Therefore, when the cut tape 4 is pulled, the cut tape 4 and the lamination part 36 (thin part) can be separated together from the zipper tape 3 at the boundary portion between the lamination part 36 (thin part) and the first strip-shaped base part 31*a*. In the present embodiment, there are again no particular restrictions on the thickness of the first strip-shaped base part 31*a* as long as the lamination part 36 can be cut off, but normally, a thickness of 150 to 170 μm is suitable. The thickness of the lamination part 36 (thin part) may be adjusted as appropriate so that separation is possible at the desired force and no moulding defects occur; for example, a thickness of about one third that of the strip-shaped base part 31*a* is suitable. In the zipper tape 3 of the present embodiment, the lamination part 36 (thin part) separated together with the cut tape 4 is thinner than in the embodiment shown in FIG. 3, and can therefore be separated using a smaller force.

FIG. 5 is a cross-section view of another embodiment of the zipper tape 3 in the vicinity of the cut tape 4. In the zipper tape 3 shown in FIG. 5, the lamination part 36 on which the cut tape 4 is laminated is formed as a thin part which is thinner than the first strip-shaped base part 31*a*, and the portion adjacent to the lamination part 36 (thin part) is formed as a first thick part 34 which is thicker than the first strip-shaped base part 31*a*. The lamination part 36 (thin part) on which the cut tape 4 is laminated is thinner than the adjacent first thick part 34. Therefore, when the cut tape 4 is pulled, the cut tape 4 and the lamination part (thin part) can be separated from the zipper tape 3 at the boundary portion between the lamination part 36 (thin part) and the first thick part 34. In the present embodiment, the thickness of the first strip-shaped base part 31*a*, and the thickness of the first thick part 34 relative to the first strip-shaped base part 31*a*, may be the same as those in the embodiment shown in FIG. 3. The thickness of the lamination part 36 (thin part) relative to the first strip-shaped base part 31*a* may be the same as that in the embodiment disclosed in FIG. 4. In the zipper tape 3 of the present embodiment, the relative thicknesses of the lamination part 36 (thin part) separated together with the cut tape 4 and the adjacent first thick part 34 can be adjusted within a wider range than that in the embodiments disclosed in FIGS. 3 and 4.

In the zipper tape 3 shown in FIGS. 3-5, the boundary portion between the lamination part 36 and the first strip-shaped base part 31*a* or the first thick part 34 is preferably angled by approximately 90° in order to facilitate separation of the cut tape 4 and the lamination part 36. An incision or a similar feature may also be formed using a gas laser or another means at the boundary portion as required. The incision, if provided, preferably measures about half the thickness of the lamination part 36 (thin part). It is undesirable for the incision to be any less than half the thickness as the incision would be ineffective, and it is undesirable for the incision to be any longer than half the thickness as there would be an increase in the risk of a cut occurring from the first strip-shaped base part 31*a* during the manufacturing process. The incision may be formed on the surface of the lamination part 36 that is bonded to the bag body 2 or on the surface on which the cut tape 4 is laminated. Alternatively, incisions may be formed to a depth of about one quarter the thickness of the lamination part 36 from both surfaces.

The zipper tapes 3 shown in FIGS. 3 to 5 are examples in which the lamination part 36 is provided at an end part of the first strip-shaped base part 31*a* and only one end of the lamination part 36 is connected to the first strip-shaped base part 31*a*. However, as shown in FIGS. 6 to 8, a configuration is possible in which the lamination part 36 is not at the end part of the first strip-shaped base part 31*a*, but both ends of the lamination part 36 are connected to the first strip-shaped base part 31*a*.

FIG. 6 is a cross-section view of another embodiment of the zipper tape 3 in the vicinity of the cut tape 4. In the embodiment shown in FIG. 6, a second thick part 35 having the same thickness and width as those of the first thick part is formed at an end part of the lamination part 36 of the embodiment shown in FIG. 3.

FIG. 7 is a cross-section view of another embodiment of the zipper tape 3 in the vicinity of the cut tape 4. In the embodiment shown in FIG. 7, the first strip-shaped base part 31*a* is also formed at an end part of the lamination part 36 of the embodiment shown in FIG. 4. No particular limitations exist for the length of the first strip-shaped base part 31*a* formed as long as the bag body 2 bonded to the lamination part 36 can be separated in a stable manner as described further below; for example, the length of the first strip-shaped base part 31*a* may be the same as that of the lamination part 36.

FIG. 8 is a cross-section view of another embodiment of the zipper tape 3 in the vicinity of the cut tape 4. In the embodiment shown in FIG. 8, a second thick part 35 having the same thickness and width as the first thick part is formed at an end part of the lamination part 36 of the embodiment shown in FIG. 5.

In the embodiments shown in FIGS. 6 to 8, as with the embodiments shown in FIGS. 3 to 5, it is preferable that the boundary portion of the lamination part 36 is angled by approximately 90°, and an incision or a similar feature may be formed by laser or another means at the boundary portion, in order to facilitate the separation of the cut tape 4 and the lamination part 36.

The height of the convex part 37 provided to the second strip-shaped base part 31*b* is at least that at which the convex part 37 can be bonded to the bag body 2. For example, in the embodiments shown in FIGS. 3 to 5, the height of the convex part 37 is equal to or greater than the thickness of the lamination part 36 and the cut tape 4. In the embodiments shown in FIGS. 6 and 8, the height is equal to or greater than the thickness of the second thick part 35, and in the embodiment shown in FIG. 7, the height is equal to or greater than the thickness of the first strip-shaped base part 31*a*.

In the first strip-shaped base part 31*a* according to the embodiments disclosed in FIGS. 3 to 5, the lamination part 36 is connected only in one direction to the first strip-shaped base part 31*a*. Therefore, bonding the convex part of the second strip-shaped base part onto the bag body 2 so as to enable contact with the lamination part 36 on which the cut tape 4 is laminated results in the convex part functioning as a guide when separating the cut tape 4 and the lamination part 36, and makes it possible to perform the separation using a small force. In addition, the convex part 37 being bonded to the bag body 2 makes it more difficult, when separating the lamination part 36 together with the cut tape 4, for the bag body 2 bonded to the lamination part 36 to be separated beyond the portion at which the convex part 37 is bonded, making it possible to stabilize the shape of an unsealing face of the bag body 2. No particular limitations exist for the lateral width of the convex part 37 as long as the guiding function can be obtained and the shape of the unsealing face can be stabilized. For example, in the embodiments shown in FIGS. 3 and 5, the width of the convex part 37 may be the same as that of the first thick part, and in the embodiment shown in FIG. 4, may be the same as that of the lamination part 36.

In the first strip-shaped base part 31*a* according to the embodiments shown in FIGS. 6 to 8, the second thick part 35 or the first strip-shaped base part 31*a* on the side of the end part of the first strip-shaped base part 31*a* fulfils the guiding function and the function of stabilizing the shape of the unsealing face. Therefore, no particular limitations exist for the width of the convex part 37 as long as stable bonding to the bag body 2 can be achieved.

The number of the male member 32 and the female member 33 provided to the zipper tape 3 of the present invention is not limited to a pair; for example, two, three, four, or other multiple pairs may be formed. In the embodiment shown in FIG. 2, the male member 32 is formed on the first strip-shaped base part 31*a* and the female member 33 is formed on the second strip-shaped base part 31*b*; however, a reverse arrangement is also possible.

FIG. 9 shows a positional relationship present when the zipper tape 3 of the present invention is used. The positions at which the male member 32, the female member 33, and the convex part are provided are preferably adjusted so as to obtain a positional relationship in which the male member 32 and the female member 33 engage with each other when the convex part 37 formed at the end part of the second strip-shaped base part 31*b* is brought into contact with the end part of the first strip-shaped base part 31*a*. The above positional relationship results in the convex part 37 being brought into contact with the first strip-shaped base part 31*a* and bonded to the bag body 2 when the convex part 37 and the first strip-shaped base part 31*a* described further below are bonded and thereby reduces the likelihood of a positional misalignment between the male member 32 and the female member 33, making it possible to reduce the defectives rate.

FIG. 10 is a cross-section view of another embodiment of the zipper tape 3 in the vicinity of the cut tape 4. In the embodiment shown in FIG. 10, a pair of locking members 38 (indicated by a white circle in the drawing) are provided so that the first strip-shaped base part 31*a* and the convex part of the second strip-shaped base part 31*b* can be locked. The locking members 38 make it possible to bond the convex part 37 and the first strip-shaped base part 31*a* to the bag body 2 in a state in which the convex part 37 and the first strip-shaped base part 31*a* are locked, making it possible to further reduce the defectives rate due to a positional misalignment during bonding. In addition, providing the locking members 38 at a position such that the convex part 37 and the first strip-shaped base part 31*a* to be bonded to the bag body 2 form a flat surface eliminates any surface unevenness when the convex part 37 and the first strip-shaped base part 31*a* are bonded to the bag body 2. Accordingly, it is possible, when, e.g., thermal fusion is performed, to further reduce the defectives rate such as melting damage in the bag body 2 caused by a surface unevenness.

No particular limitations exist for the shape of the locking members 38, the member and the position to which the locking members 38 are provided, and the quantity of the locking members 38, as long as the locking members 38 are able to lock the convex part 37 and the first strip-shaped base part 31*a*. For example, with regards to the shape, a pointed part may be provided at an end part of the lamination part 36 and a member shaped so as to fit with the pointed part may be provided to the convex part 37 as shown in FIG. 10; alternatively, a convex part and a concave part, or a male member and a female member, may be provided. In addition, the members may be provided to either of the convex part 37 or the first strip-shaped base part 31*a*. In addition, in the embodiment shown in FIG. 10, the locking members 38 are provided to the convex part 37 and the lamination part 36 of the first strip-shaped base part 31*a*; however, the locking members 38 may be provided, e.g., at a position at which the cut tape 4 and the convex part 37 can be locked. Alternatively, the locking members 38 are not limited to a pair; a plurality of pairs of the locking members 38 may be provided, such as to the lamination part 36 and the convex part 37 and to the cut tape 4 and the convex part 37.

In a case in which the end part of the first strip-shaped base part 31*a* is configured as in the embodiments shown in FIGS. 6 and 8, the locking members 38 may be provided between the second thick part 35 and the convex part 37, and in a case in which the end part of the first strip-shaped base part 31*a* is configured as in the embodiment shown in FIG. 7, the locking members 38 may be provided between the first strip-shaped base part 31*a* and the convex part 37.

The zipper tape 3 of the embodiments shown in FIGS. 3 to 10 can be integrally produced by extrusion forming using dies shaped as the first strip-shaped base part 31*a* and the second strip-shaped base part 31*b* of the corresponding embodiment. Laminating a separately produced cut tape 4 on the produced zipper tape 3 makes it possible to produce the zipper tape with a cut tape of the present invention.

The material forming the first strip-shaped base part 31*a* and the second strip-shaped base part 31*b*, and the male member 32, the female member 33, the first thick part 34, the second thick part 35, the lamination part 36, the convex part 37, and the locking members 38 provided to the strip-shaped base parts is preferably a low-density polyethylene or another polyethylene resin, a polypropylene resin, or a copolymer thereof or another polyolefin resin, taking into account factors such as moldability and heat fusability, which represents the adhesion performance with respect to the bag body 2. Examples of the polypropylene resin that can be used include: homopolypropylene, block polypropylene, random polypropylene (RPP), a propylene-ethylene-butene-1 random terpolymer, a polyolefin-based special soft resin (TPO resin; e.g., prime polymer TPO), or another thermoplastic resin; or a mixture of the above resins.

Examples of the material forming the cut tape 4 include stretched polyethylene terephthalate (OPET), stretched polypropylene (OPP), stretched high-density polyethylene (HDPE), or another resin that is different from and incompatible with the material constituting the zipper tape 3. The cut tape 4 may be laminated with an adhesive such as metallocene LL and bonded to the lamination part 36 of the zipper tape 3.

If the contents placed in the packaging bag 1 are contents intended for human consumption, such as food or medicine, it is undesirable for the contents to come into contact with the adhesive. In such a case, fusing may be performed by compounding the cut tape 4 and the zipper tape 3 with a resin of the same kind having a relatively low melting point. For example, using polyethylene (PE) as the low-melting-point thermoplastic resin, producing the zipper tape 3 from polyethylene (PE), and producing the cut tape 4 from a mixture of polyethylene (PE) and polypropylene (PP) make it possible to fuse and laminate the cut tape 4 on the lamination part 36 of the zipper tape 3 without using an adhesive. Specifically, bonding can be performed using the procedure of (1) cooling the zipper tape 3 extruded through a die in a water tank, and (2) placing the cut tape 4, which has been extruded through a die, on the lamination part 36 of the zipper tape 3 and cooling the cut tape 4 in a water tank. The magnitude of the bonding force can be adjusted through the polyethylene (PE) content of the cut tape 4.

FIG. 11 is a cross-section view along a-a of the packaging bag 1 shown in FIG. 1. In the packaging bag 1 shown in FIG. 11, a surface of the first strip-shaped base part 31*a* including at least the lamination part 36 and the convex part 37 of the second strip-shaped base part 31*b* are bonded to one surface 2*b* of the bag body 2. When the contents are sealed in the packaging bag 1, e.g., the zipper tape 3 is bonded to a film 2*b* constituting the bag body 2, the surrounding parts of the 2*a* and the 2*b* (*8) constituting the bag body 2 other than the portion bonded to the zipper tape 3 are sealed using a polyester/isocyanate-based two-component or other configurations of adhesive or by thermal fusion or other means, the contents are introduced in the packaging bag 1 through the open portion, and then the open portion is lastly sealed using the same means as above. As shown in FIG. 1, a tab 41 is formed at one end of the cut tape 4 by an incision penetrating the bag body 2 and the first strip-shaped base part 31*a* by, e.g., pressing a die thereagainst. Pinching the tab 41 and pulling the tab 41 away from the bag body 2 separates the cut tape 4 continuing from the tab 41, and the lamination part 36 and the bag body 2 separate as the cut tape 4 separates, making it possible to open the packaging bag 1. If matter intended for human consumption such as food or medicine is sealed as the contents, the bonding of the zipper tape 3 to the bag body 2 and the sealing of the surrounding part of the packaging bag 1 may be performed by thermal fusion.

The bonding of the first strip-shaped base part 31*a* to the bag body 2 is preferably such that at least the lamination part 36 and a portion adjacent to the lamination part 36 are bonded. It is undesirable for the adjacent portion not to be bonded to the bag body 2, as the bag body 2 would be cut open not only at the portion of the bag body 2 bonded to the lamination part 36 but also at the portion of the bag body 2 that is not bonded to the lamination part 36, making the shape of the unsealing face less stable. In the present invention, the "adjacent portion" signifies a portion necessary for the bag body 2 bonded to the lamination part 36 to be separated in a stable manner, and, e.g., in the embodiments shown in FIGS. 3 and 5, may correspond to the first thick part 34, and in the embodiment shown in FIG. 4, may correspond to a length that is the same as that of the lamination part 36. The adjacent portion, in the embodiments shown in FIGS. 6 and 8, may correspond to the second thick part 35 on the left side of the drawing, and in the embodiment shown in FIG. 7, may correspond to the portion of the first strip-shaped base part 31*a* on the left side of the drawing. It shall be apparent that as long as the shape in which the bag body 2 is cut open is uniform, the length may be greater or smaller than those described above.

FIG. 12 is a cross-section view along a-a according to another embodiment of the packaging bag 1 of the present invention. In the embodiment shown in FIG. 12, bonding 39 is provided between an end part of the first strip-shaped base part 31*a* on the side at which the lamination part 36 is not provided, and an end part of the second strip-shaped base part 31*b* on the side at which the convex part 37 is not provided. In a case when a conventional packaging bag 1 contains a liquid or the like, the engaging part of the zipper may become wet when the packaging bag 1 is turned upside down, and if the sealing of the engaging part is not complete, the portion on which the cut tape 4 is laminated, which is further towards the opening than the engaging part, may also become wet, even if the packaging bag 1 has not yet been unsealed. Therefore, a problem is presented in that when a liquid is found to be present at the unsealed portion when the cut tape 4 is pulled, the consumer may conclude that the packaging bag 1 was leaking, i.e., that the packaging bag 1 is defective.

In the packaging bag 1 of the embodiment shown in FIG. 12, bonding 39 is provided between the respective end parts of the first strip-shaped base part 31*a* and the second strip-shaped base part 31*b* on the contents side. Therefore, even liquid contents are prevented from flowing backwards, and the engaging part and the unsealing face are prevented from becoming wet. The bonding 39 portion is bonded at a strength such that the bonding 39 portion readily separates, once the cut tape 4 has been pulled, as the packaging bag 1 is first unsealed and the zipper tape 3 is opened.

The packaging bag 1 of the embodiment shown in FIG. 12 may be obtained by producing the packaging bag 1 using the same procedure as that for the embodiment shown in FIG. 11, and then bonding the end parts by thermal fusion or another method before sealing the contents.

INDUSTRIAL APPLICABILITY

In the zipper tape with a cut tape of the present invention, a lamination part at which a cut tape is laminated on one of strip-shaped base parts constituting the zipper tape is formed so as to be relatively thin, a convex part is provided to the other strip-shaped base part, and the zipper tape with a cut tape can be bonded to a bag body by bringing the convex part to the one of the strip-shaped base parts. Therefore, in a packaging bag provided with the zipper tape with a cut tape of the present invention, the zipper tape is bonded to the bag body at only two locations, and the manufacturing process is simple, making it possible to reduce the defectives rate. The present invention is therefore useful in fields such as that of openable/closable packaging bags.

The invention claimed is:

1. A zipper tape with a cut tape, the zipper tape with a cut tape including a first strip-shaped base part provided with a male member, a second strip-shaped base part provided with a female member for engaging with the male member, and a cut tape;

one strip-shaped base part among the first strip-shaped base part and the second strip-shaped base part including a lamination part for laminating a cut tape, the lamination part being formed so as to be thinner than an adjacent strip-shaped base part and connected to the strip-shaped base part directly, wherein the one strip-shaped base part and the lamination part are composed in one piece, and are formed by same material;

the cut tape is laminated on the lamination part, and a convex part to be bonded to a bag body being formed at an end part of the other strip-shaped base part, and the height of the convex part being equal to or greater than the thickness of a lamination part side end part of the strip-shaped base part on which the lamination part is formed.

2. The zipper tape with a cut tape according to claim 1, wherein the lamination part is formed as a thin part which is thinner than the strip-shaped base part excluding the lamination part.

3. The zipper tape with a cut tape according to claim 1, wherein the strip-shaped base part adjacent to the lamination part is formed as a first thick part and a second thick part which are thicker than the lamination part.

4. The zipper tape with a cut tape according to claim 1, wherein the lamination part is formed as a thin part which is thinner than the strip-shaped base part, and portions adjacent to the lamination part are formed as a first thick part and a second thick part which are thicker than the strip-shaped base part.

5. The zipper tape with a cut tape according to claim 1, wherein the lamination part formed as a thin part is formed at an end part of the strip-shaped base part so as to be thinner than the strip-shaped base part adjacent to one end of the lamination part.

6. The zipper tape with a cut tape according to claim 1, wherein the lamination part is formed at an end part of the strip-shaped base part, and a portion adjacent to one end of the lamination part is formed as a first thick part thicker than the strip-shaped base part.

7. The zipper tape with a cut tape according to claim 1, wherein the lamination part is formed at an end part of the strip-shaped base part, a portion adjacent to one end of the lamination part is formed as a first thick part thicker than the strip-shaped base part, and the lamination part is formed as a thin part thinner than the strip-shaped base part.

8. The zipper tape with a cut tape according to claim 1, wherein the convex part, the male member, and the female member are formed at a position at which the male member and the female member engage when an end part, on the side at which the lamination part is provided, of the strip-shaped base part that includes the lamination part, has the convex part of the other strip-shaped base part brought into contact therewith.

9. The zipper tape with a cut tape according to claim 1, provided with a locking member capable of locking an end part of the strip-shaped base part that includes the lamination part and the convex part of the other strip-shaped base part to each other.

10. The zipper tape with a cut tape according to claim 9, wherein the locking member is provided at a position at which a face along which the convex part and the strip-shaped base part that includes the lamination part are bonded to the bag body forms a flat surface when the end part of the strip-shaped base part that includes the lamination part and the convex part of the other strip-shaped base part are locked to each other.

11. The zipper tape with a cut tape according to claim 1, wherein an incision line is provided at a boundary between the lamination part and the adjacent portion.

12. The zipper tape with a cut tape according to claim 1, wherein at least two or more pairs of the male member and the female member are provided.

13. A packaging bag provided with a zipper tape with a cut tape, to which is bonded the zipper tape with a cut tape according to any one of the preceeding claims.

14. The packaging bag provided with a zipper tape with a cut tape according to claim 13, wherein the lamination part and the portion adjacent to the lamination part, and the convex part, of the zipper tape with a cut tape are bonded to at least the packaging bag.

15. The packaging bag provided with a zipper tape with a cut tape according to claim 13, wherein an end part of a strip-shaped base part on the opposite side from the lamination part of the strip-shaped base part provided with the lamination part, and an end part of a strip-shaped base part on the opposite side from the convex part of the strip-shaped base part provided with the convex part, are bonded to each other.

16. The packaging bag provided with a zipper tape with a cut tape according to claim 14, wherein an end part of a strip-shaped base part on the opposite side from the lamination part of the strip-shaped base part provided with the lamination part, and an end part of a strip-shaped base part on the opposite side from the convex part of the strip-shaped base part provided with the convex part, are bonded to each other.

* * * * *